US009506366B2

(12) United States Patent
Danescu et al.

(10) Patent No.: US 9,506,366 B2
(45) Date of Patent: Nov. 29, 2016

(54) HELICAL SEAL SYSTEM FOR A TURBOMACHINE

(71) Applicant: General Electric Company, Schenectady, NY (US)

(72) Inventors: Radu Ioan Danescu, Greer, SC (US); David Martin Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 588 days.

(21) Appl. No.: 13/960,285

(22) Filed: Aug. 6, 2013

(65) Prior Publication Data

US 2015/0040566 A1 Feb. 12, 2015

(51) Int. Cl.
*F01D 11/02* (2006.01)
*F01D 11/00* (2006.01)

(52) U.S. Cl.
CPC ..... *F01D 11/02* (2013.01); *F01D 11/001* (2013.01); *F05D 2250/25* (2013.01); *F05D 2250/281* (2013.01)

(58) Field of Classification Search
CPC ..... F01D 11/08; F01D 5/225; F01D 11/02; F01D 11/001; F01D 5/20; F01D 5/066; F01D 5/081; F01D 5/025
USPC ..... 418/173.5, 174.5, 170.1
See application file for complete search history.

(56) References Cited

U.S. PATENT DOCUMENTS 1,831,242 A 11/1931 Hanzlik
3,519,277 A 7/1970 Crocker
3,795,386 A * 3/1974 Carter ..... F16J 15/406 100/145
4,084,825 A 4/1978 Ludwig
4,500,254 A * 2/1985 Roznieck ..... F01D 1/18 415/75
5,222,742 A 6/1993 Roberts
5,244,216 A 9/1993 Rhode
5,343,697 A 9/1994 Johnson et al.
5,735,667 A 4/1998 Sanders et al.
6,969,231 B2 11/2005 Ghasripoor et al.
7,430,802 B2 10/2008 Tiemann
7,828,297 B2 11/2010 Hoebel et al.
8,066,475 B2 11/2011 Bulgrin et al.
8,215,914 B2 7/2012 Danescu et al.
8,333,544 B1 12/2012 Pelfrey
8,388,310 B1 3/2013 Diakunchak
8,393,859 B1 3/2013 Dillon
2008/0007008 A1 1/2008 Hoebel et al.
2008/0066444 A1* 3/2008 Cornelius ..... F01D 11/04 60/39.181
2009/0058013 A1* 3/2009 Bulgrin ..... F01D 11/02 277/419
2011/0123378 A1 5/2011 Kothnur et al.
2011/0163505 A1* 7/2011 Bhagavatheeswaran F16J 15/4472 277/303

(Continued)

FOREIGN PATENT DOCUMENTS

JP 110280679 A 10/1999

*Primary Examiner* — Patrick Maines
(74) *Attorney, Agent, or Firm* — Ernest G. Cusick; Frank A. Landgraff

(57) ABSTRACT

A helical seal system includes a first component, and a second component rotatable relative to the first component. The second component extends from a high pressure portion to a low pressure portion through an intermediate portion. A helical seal is provided on the intermediate portion of the second component. The helical seal includes at least one thread component having a pitch that is configured and disposed to draw fluids from the low pressure portion toward the high pressure portion when the second component is rotated.

7 Claims, 3 Drawing Sheets

(56) References Cited

U.S. PATENT DOCUMENTS

2011/0280715 A1* 11/2011 Garg ..... F01D 11/001 415/174.5
2012/0093633 A1 4/2012 Kasibhotla et al.
2012/0114458 A1* 5/2012 Dutka ..... F01D 11/001 415/1
2012/0193875 A1* 8/2012 Deo ..... F01D 11/003 277/412
2013/0214492 A1* 8/2013 Nielsen ..... F01D 25/186 277/347
2014/0023487 A1* 1/2014 Dougan ..... F01D 25/243 415/144
2014/0064909 A1* 3/2014 Trivedi ..... F01D 11/001 415/1

* cited by examiner

HELICAL SEAL SYSTEM FOR A TURBOMACHINE

BACKGROUND OF THE INVENTION

The subject matter disclosed herein relates to the art of turbomachines and, more particularly, to a helical seal for a turbomachine.

Gas turbomachines include a compressor portion linked to a turbine portion through a common compressor/turbine shaft and a combustor assembly. An inlet airflow is passed through an air intake toward the compressor portion. In the compressor portion, the inlet airflow is compressed through a number of sequential stages toward the combustor assembly. In the combustor assembly, the compressed airflow mixes with a fuel to form a combustible mixture. The combustible mixture is combusted in the combustor assembly to form hot gases. The hot gases are guided to the turbine portion through a transition piece. The hot gases expand through a number of turbine stages acting upon turbine buckets mounted on wheels to create work that is output, for example, to power a generator, a pump, or to provide power to a vehicle.

Additional gases, in the form of compressed air, flow from the compressor portion into the turbine portion for cooling. Seals are provided in the turbomachine to substantially isolate the hot gases and compressed airflow for cooling. Additional seals are positioned to prevent gases at a higher pressure leaking toward gases of a lower pressure without creating work resulting in a reduction in turbomachine efficiency. Other seals are provided about rotating components to prevent compressor airflow leakage.

BRIEF DESCRIPTION OF THE INVENTION

According to one aspect of the exemplary embodiment, a helical seal system includes a first component, and a second component rotatable relative to the first component. The second component extends from a higher pressure portion to a lower pressure portion through an intermediate portion. A helical seal is provided on the intermediate portion of the second component. The helical seal includes at least one thread component having a pitch that is configured and disposed to draw fluids from the lower pressure portion toward the higher pressure portion when the second component is rotated.

According to another aspect of the exemplary embodiment, a turbomachine includes a housing, a compressor portion, and a turbine portion operatively connected to the compressor portion. The turbine portion includes at least one turbine stage having a turbine spacer wheel. A shaft is arranged in the housing and is operatively connected to at least one of the compressor portion and the turbine portion. The shaft extends from a higher pressure portion to a lower pressure portion. A combustor assembly including at least one combustor is fluidically connected to the compressor portion and the turbine portion. A helical seal is provided on one of the shaft and the turbine spacer wheel. The helical seal includes at least one thread component having a pitch that is configured and disposed to draw fluids from the lower pressure portion toward the higher pressure portion when the one of the shaft and the turbine spacer wheel is rotated.

According to yet another aspect of the exemplary embodiment, a turbomachine system includes a first component and a second component rotatable relative to the first component. The second component extends from a high pressure portion to a low pressure portion through an intermediate portion. A helical seal is provided on the intermediate portion of the second component. The helical seal includes at least one thread component having a pitch that is configured and disposed to draw fluids from the low pressure end toward the high pressure end when the second component is rotated.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
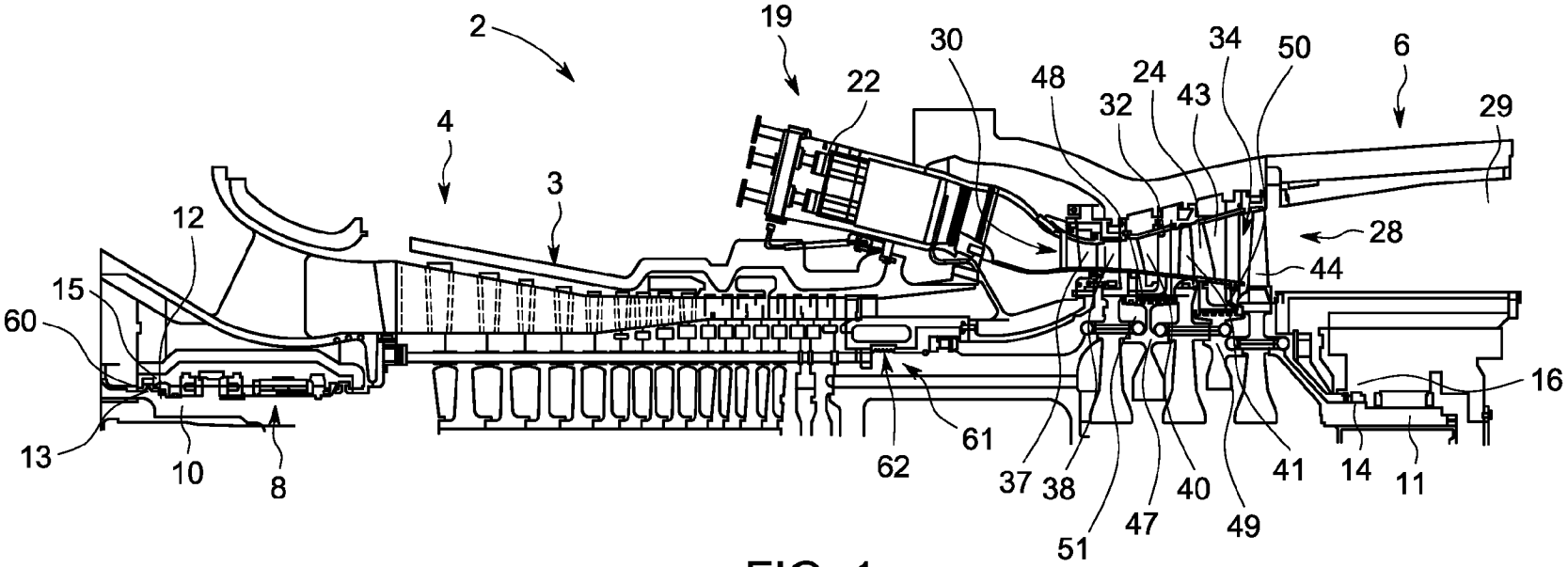
FIG. 1 is a partial cross-sectional schematic view of a turbomachine including a helical seal, in accordance with an exemplary embodiment.

A turbomachine in accordance with an exemplary embodiment is illustrated generally at 2, in FIG. 1. Turbomachine 2 includes a housing 3 that supports a compressor portion 4 and a turbine portion 6. Compressor portion 4 is mechanically linked to turbine portion 6 though a rotor 8 that extends from a forward (compressor) end 10 to an aft (turbine) end 11. Rotor 8 includes an outer diametric surface component 12 that is provided with a first or forward bearing 13 and a second or aft bearing 14. Rotor 8 is supported relative to a first shaft support component 15 (first component) and a second shaft support component 16 (second component). More specifically, first and second bearings 13 and 14 provide an interface between rotor 8 and respective ones of first and second shaft support components 15 and 16. Turbomachine 2 also includes a combustor assembly 19 having one or more combustors 22.

Air enters compressor portion 4 through an inlet (not separately labeled). The air passes through a plurality of compressor stages (also not separately labeled) toward turbine portion 6 and combustor 22. Compressed air enters combustor 22 and mixes with fuel to form a combustible mixture. The combustible mixture combusts forming hot gases that flow along a hot gas path 24 of turbine portion 6.

The hot gases expand through a number of turbine stages 28 toward an exhaust 29. In the exemplary embodiment shown, the hot gases expand through a first stage 30, a second stage 32, and a third stage 34. First stage 30 includes a first plurality of nozzle components 37 and blade components 38. Second stage 32 includes a second plurality of nozzle components 40 and blade components 41, and third stage 34 includes a third plurality of nozzle components 43 and blade components 44. Nozzle components 37, 40 and 43 guide the hot gases toward respective ones of blade components 38, 41 and 44. The hot gases impinge upon the blade components 38, 41 and 44 creating a rotational force that is passed to a driven system, such as a generator, a pump or the like (not shown).

Turbine portion 6 also includes a first turbine spacer wheel 47 having an outer diametric surface sealing component 48 (first component) and a second turbine spacer wheel 49 having an outer diametric surface sealing component 50 (second component). First and second turbine spacer wheels 47 and 49 are interposed between adjacent turbine wheels (not separately labeled). First turbine spacer wheel 47 is positioned between first and second stages 30 and 32 and second turbine spacer wheel 49 is positioned between second and third stages 32 and 34. Each outer diametric surface sealing components 48 and 50 includes a helical seal 55 (FIG. 4) which, as will be detailed more fully below, reduces leakage flow from higher pressure portions to lower pressure portion in turbine portion 6. Turbomachine 2 also includes a helical seal 60 arranged at forward end 10 of rotor 8. Helical seal 60 reduces lubricant or other leakage between outer diametric surface 12 and shaft support 15. Turbomachine 2 may also include a high pressure packing seal 61 having a helical seal 62. An additional helical seal (not separately labeled) is provided at aft end 11.

Figure 2:
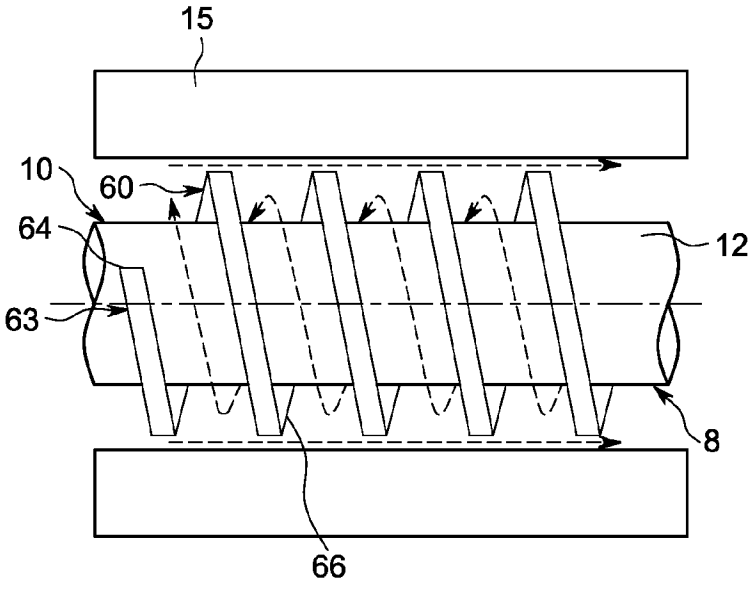
FIG. 2 is a partial plan view of a shaft having a helical seal, in accordance with a first aspect of the exemplary embodiment.

As best shown in FIG. 2, helical seal 60 includes a thread component 63 that extends from a first end 64 to a second end (not shown) arranged on an opposing side of rotor 8. Thread component 63 includes a plurality of thread sections, one of which is indicated at 66. Thread component 63 includes a pitch (not separately labeled) that, when rotated, draws or pumps fluid, such as air, along outer diametric surface 12. In accordance with one aspect of the exemplary embodiment, thread component 63 includes a pitch that pumps fluid from a low pressure portion of rotor 8 to a high pressure portion of rotor 8 to reduce leakage from high pressure portions to low pressure portions along outer diametric surface 12. The particular angle of the pitch may vary depending upon the position of helical seal 60. In accordance with another aspect of the exemplary embodiment, thread component 63 is materially integrally formed with outer diametric surface 12. More specifically, thread component 63 is machined into rotor 8. However, it should be understood, that thread component 63 may be formed on a separate sleeve-like component that is secured to outer diametric surface 12.

Figure 3:
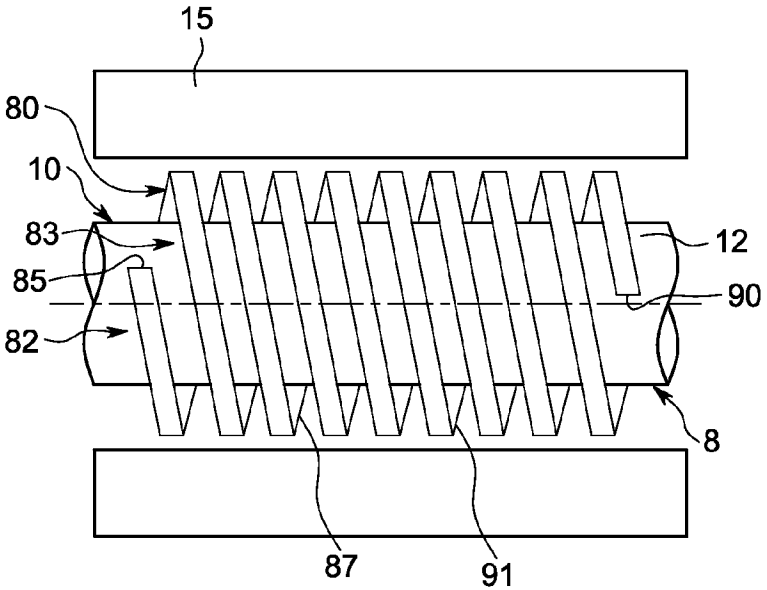
FIG. 3 is a partial plan view of a shaft having a helical seal, in accordance with another aspect of the exemplary embodiment.

FIG. 3, in which like reference numbers represent corresponding parts in the respective views, illustrates a helical seal 80, in accordance with another aspect of the exemplary embodiment. Helical seal 80 includes a first thread component 82 (first component) and a second thread component 83 (second component). First thread component 82 extends from a first end 85 to a second end (not shown) and includes a plurality of thread sections, one of which is indicated at 87. Second thread component 83 extends from a first end (not shown) to a second end 90 and includes a plurality of thread portions, one of which is indicated at 91. Thread portions 91 are arranged between adjacent ones of thread sections 87.

In a manner similar to that described above, first thread component 82 and second thread component 83 each includes a pitch (not separately labeled) that pumps fluid from a low pressure portion of rotor 8 to a high pressure portion of rotor 8 to reduce ambient air ingestion along outer diametric surface 12. The particular angle of the pitch may vary depending upon the position of helical seal 80. In accordance with another aspect of the exemplary embodiment, first and second thread components 82 and 83 are materially integrally formed with outer diametric surface 12. More specifically, first thread component 82 and second thread component 53 are machined into rotor 8. However, it should be understood, that first thread component 83 and second thread component 83 may be formed on a separate sleeve-like component that is secured to outer diametric surface 12.

Figure 4:
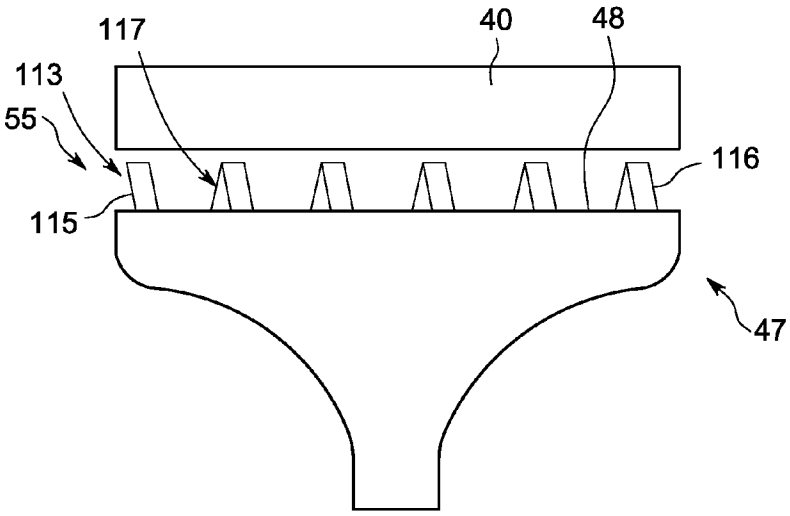
FIG. 4 is a partial plan view of a portion of a turbine spacer wheel having a helical seal, in accordance with yet another aspect of the exemplary embodiment.
Figure 5:
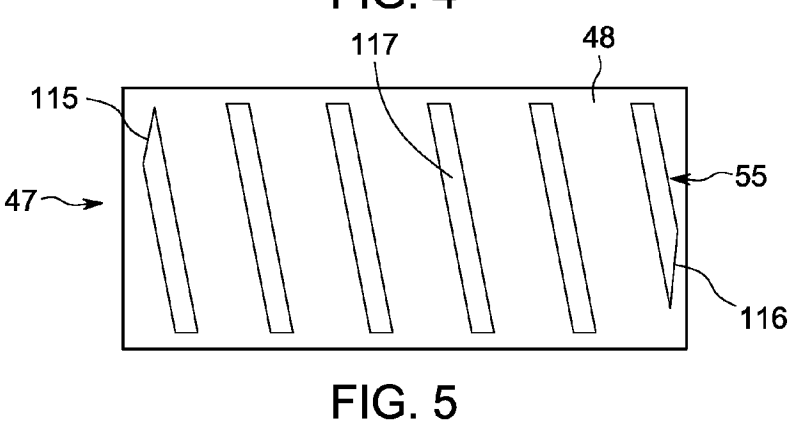
FIG. 5 is a top view of the turbine spacer wheel of FIG. 4.

Reference will now follow to FIGS. 4 and 5, wherein like reference numbers represent corresponding parts in the respective views, in describing helical seal 55. Helical seal 55 includes a thread component 113 that extends from a first end 115 to a second end 116. Thread component 113 includes a plurality of thread sections, one of which is indicated at 117. Thread component 113 includes a pitch (not separately labeled) that, when rotated, draws or pumps fluid, such as air, along outer diametric surface 48 from a lower pressure portion to a higher pressure portion.

In accordance with one aspect of the exemplary embodiment, thread component 113 includes a pitch (not separately labeled) that creates a reverse fluid flow across outer diametric surface 48. More specifically, the fluid flows from a low pressure portion to a high pressure portion of wheelspace portion 51 to reduce leakage flow from turbine portion 6. The particular angle of the pitch may vary. In accordance with another aspect of the exemplary embodiment, thread component 113 is materially integrally formed with outer diametric surface component 48. More specifically, thread component 113 is machined into outer diametric surface component 48. However, it should be understood, that thread component 113 may be formed on a separate sleeve-like component that is secured to first turbine spacer wheel 47.

Figure 6:
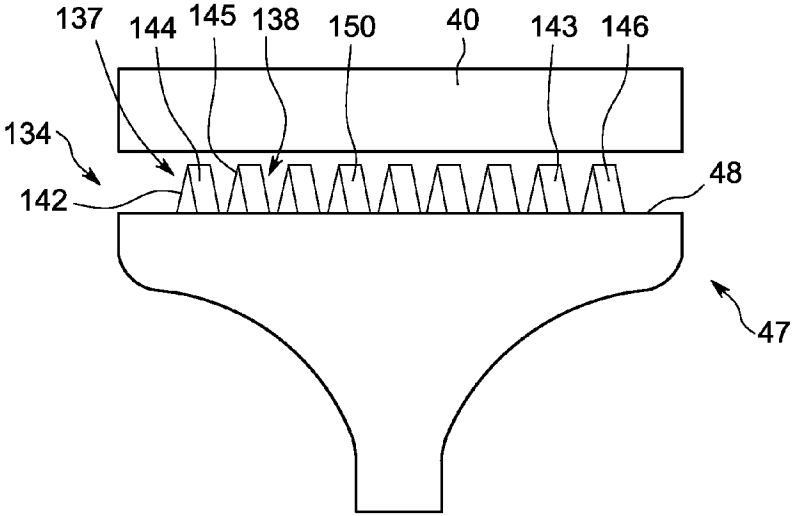
FIG. 6 is a partial plan view of a turbine spacer wheel having a helical seal, in accordance with a yet still another aspect of the exemplary embodiment.
Figure 7:
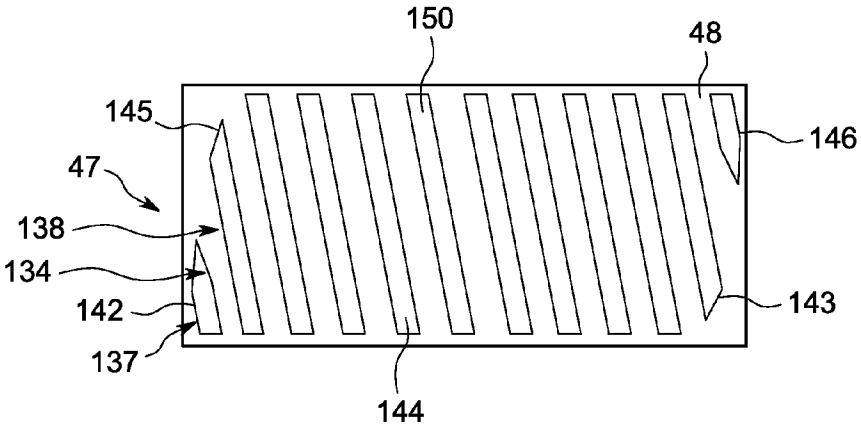
FIG. 7 is a top view of the turbine spacer wheel of FIG. 6.

Reference will now follow to FIGS. 6 and 7, wherein like reference numbers represent corresponding parts in the respective views, in describing helical seal 134, in accordance with another exemplary embodiment. Helical seal 134 includes a first thread component 137 and a second thread component 138. First thread component 137 extends from a first end 142 to a second end 143 and includes a plurality of thread sections, one of which is indicated at 144. Second thread component 138 extends from a first end 145 to a second end 146 and includes a plurality of thread portions, one of which is indicated at 150. Thread portions 150 are arranged between adjacent ones of thread sections 144.

In a manner similar to that described above, first thread component 137 and second thread component 138 each includes a pitch (not separately labeled) that pumps fluid from a low pressure portion to a high pressure portion of wheelspace portion 51 to reduce leakage flow. The particular angle of the pitch may vary. In accordance with another aspect of the exemplary embodiment, first and second thread components 137 and 138 are materially integrally formed with outer diametric surface 48. More specifically, first and second thread components 137 and 137 are machined into first turbine spacer wheel 47. However, it should be understood, that first thread component 137 and second thread component 138 may be formed on a separate sleeve-like component that is secured to first turbine spacer wheel 47.

At this point it should be understood that the exemplary embodiments describe a helical seal that creates a reverse fluid flow to opposed leakage fluid in a turbomachine. The particular pitch of the helical seal may vary. The number and geometry of the thread components may also vary. Further, the location of the helical seal may vary and should not be considered to be limited to the particular arrangement shown. More specifically, the helical seal may be positioned as a turbine inter-stage seal, as shown in FIG. 4, a bearing seal, as shown in FIG. 2, and high pressure packing seal or other type of seal in the turbomachine. Finally, the helical seal may be materially integrally formed with one of the components to be sealed, or may be formed on a separate component that is joined to one of the components to be sealed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine comprising:

a housing;

a compressor portion;

a turbine portion operatively connected to the compressor portion, the turbine portion including at least one turbine stage having a turbine spacer wheel;

a shaft arranged in the housing and operatively connected to at least one of the compressor portion and the turbine portion, the shaft extending from a first high pressure portion to a second low pressure portion, where pressure at the first pressure portion is greater than pressure at the second pressure portion;

a combustor assembly including at least one combustor fluidically connected to the compressor portion and the turbine portion; and a helical seal provided on one of the shaft and the turbine spacer wheel, the helical seal including at least one thread component having a pitch that is configured and disposed to draw fluids from the low pressure portion to the high pressure portion when the one of the shaft and the turbine spacer wheel is rotated, wherein the at least one thread component includes a first thread component and a second thread component that is distinct from the first thread component, and wherein the first thread component includes a plurality of thread sections and the second thread component includes a plurality of thread portions, at least one of the plurality of thread portions being arranged between two adjacent ones of the plurality of thread sections.

2. The turbomachine according to claim 1, wherein the at least one thread component is materially, integrally formed with the shaft.

3. The turbomachine according to claim 1, wherein the at least one thread component is materially integrally formed with the turbine spacer wheel.

4. The turbomachine according to claim 1, wherein the helical seal is provided on an outer diametric surface of the turbine spacer wheel.

5. The turbomachine according to claim 1, wherein the helical seal is provided on the shaft.

6. The turbomachine according to claim 5, wherein the helical seal comprises a bearing seal.

7. The turbomachine according to claim 5, wherein the helical seal comprises a high pressure packing seal.

* * * * *